United States Patent [19]

Rupprecht et al.

[11] 4,034,982

[45] July 12, 1977

[54] HAND HELD DEFENSIVE WEAPON

[76] Inventors: Roswitha Eva Rupprecht; Francisco Javier Vargas, both of 4374 Louisiana St., San Diego, Calif. 92104

[21] Appl. No.: 673,079

[22] Filed: Apr. 2, 1976

[51] Int. Cl.[2] ..... F41B 15/00

[52] U.S. Cl. ..... 273/84; 63/1 R

[58] Field of Search ..... 273/81.3, 84 R; 63/1 R, 63/15, 31; D45/10 A, 10 B, 10 C

[56] References Cited

U.S. PATENT DOCUMENTS

| | | | |
|---|---|---|---|
| 756,182 | 3/1904 | Novak | 273/84 R |
| 1,586,412 | 5/1926 | Curtis | 273/84 R |
| 2,099,447 | 11/1937 | Matsuyama | 273/84 R |
| 2,257,227 | 9/1941 | Dater | 273/84 R |
| 3,106,398 | 10/1963 | Gowdey | 273/84 |
| 3,154,056 | 10/1964 | Strange | D45/10 A X |
| 3,385,601 | 5/1968 | Black | 273/84 R |
| 3,533,630 | 10/1970 | Monaco | 273/81.3 |
| 3,995,447 | 12/1976 | Levsunov | 273/84 R X |
| D. 204,765 | 5/1966 | Black | 273/84 R X |
| D. 205,899 | 10/1966 | Zimmerman | 63/15 X |
| D. 228,758 | 10/1973 | Petrosky | 273/84 X |

FOREIGN PATENT DOCUMENTS

| | | | |
|---|---|---|---|
| 280,147 | 11/1927 | United Kingdom | 273/84 R |

*Primary Examiner*—Richard J. Apley
*Attorney, Agent, or Firm*—Brown & Martin

[57] ABSTRACT

The principal element of the weapon is an elongated shaft sized to be grasped within the defender's fist and to extend beyond both sides of the hand. A finger ring is pivotally mounted on the shaft and is sized to be received over the defender's middle finger. The pivot point is offset from the longitudinal center of the shaft so that the shaft rotates under the influence of gravity, and the defender's hand movements, between cross-palm and finger aligned positions.

12 Claims, 5 Drawing Figures

HAND HELD DEFENSIVE WEAPON

BACKGROUND OF THE INVENTION

The increase in violent crimes has been well documented. Crimes of violence against the person, such as mugging are increasing at such a rapid rate that in some areas it is unsafe to venture out without some form of protection.

Many persons carry fire arms, knives and other deadly weapons as protection against attackers. However, carrying such weapons is normally illegal and is attendant with so many dangers and potential liabilities involving their use that non-lethal defensive weapons have been proposed. Such defensive weapons are intended to give the defender sufficient ability to ward off, or defensively injure an attacker, the the attacker will be discouraged and will leave the potential victim unharmed.

Various types of hand held clubs and striking implements have been proposed. Such devices normally have a large diameter handle which is grasped in the defender's hand. If the attacker is able to grasp any portion of the device, the attacker is likely to be able to wrench the device from the defender's hands and thereby expose the defender to further attack and reprisal. Many of the devices are to large to be conveniently and inconspicuously carried. The smallest of the previously known hand held devices obtain their compactness by a compromise in the usefulness of the device in warding off an attack. Normally such smaller hand held devices are useful, if at all, only in striking defensive blows, and not in warding off attach such as by parrying knife blows.

Therefore, it is desirable to have a hand held defensive weapon that is small and may be substantially concealed in the palm of the hand while at the same time providing good defensive blow capability and protection against an attacker's thrusts. Such a device is particularly valuable where it is not easily wrenched from the defender's grasp and where it is easily manipulated between protective and defensive blow striking positions.

SUMMARY OF THE INVENTION

An exemplary embodiment of the invention incorporates a metal shaft pivotally attached to a finger ring. The diameter of the shaft is such that the defender may easily grasp the shaft within his closed fist without reducing the power of the fist. The shaft extends beyond the closed fist on both the thumb and small finger sides of the fist so that defensive blows may be struck in either direction. Defensive blows may also be struck with the finger ring.

When rotated to a finger aligned position, the shaft may be concealed behind the extended hand of the defender. The finger aligned orientation of the shaft is also utilized to ward off the attacker's thrusts, such as by a stick or similar implement swung at the defender from above.

When the shaft is turned crosswise to the palm, with the fingers extended, the shaft serves to parry attacking thrusts, such as knife thrusts directed at the defender's mid-section.

The selective rotational orientation of the shaft is facilitated by positioning the pivot point offset from the longitudinal center of the shaft. The device is then worn on the middle finger of the user. The inbalance created by the off center mounting of the pivot results in the longer portion of the shaft seeking the vertical. Further, by appropriate hand movements and by the timing of the release of pressure on the shaft and the grasping of the shaft in its new position, the defender may manipulate the shaft between finger-aligned and cross-palm positions without utilizing his other hand.

It is therefore an object of the invention to provide a new and improved hand held defensive weapon.

It is another object of the invention to provide a new and improved hand held defensive weapon that may be substantially concealed within the defender's hand.

It is another object of the invention to provide a new and improved hand held defensive weapon that may be utilized to discourage or disable an attacker without inflicting deadly force.

It is another object of the invention to provide a new and improved hand held defensive weapon that is useful in parrying attackers thrusts as well as in striking defensive blows.

It is another object of the invention to provide a new and improved hand held defensive weapon that may be operated by manipulation of the hand in which the weapon is held.

It is another object of the invention to provide a new and improved hand held defensive weapon that may be utilized to deliver defensive blows and to protect against an attacker's thrusts without exerting excessive forces on the defender's hand.

Other objects and many attendant advantages of the invention will become more apparent upon the reading of the following detailed description together with the drawings in which like reference numerals refer to like parts throughout and in which.

DETAILED DESCRIPTION OF THE DRAWINGS

Figure 1:
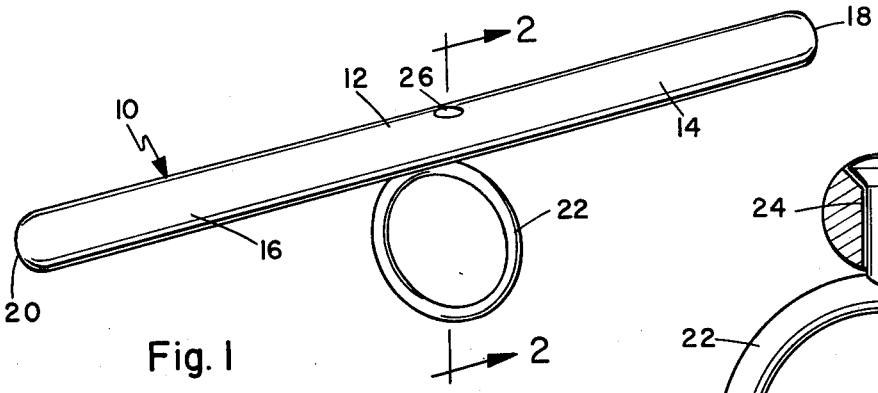
FIG. 1 is a perspective view of the weapon.
Figure 2:
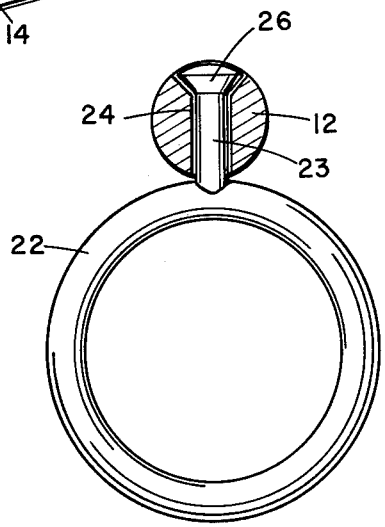
FIG. 2 is an enlarged sectional view taken on line 2—2 of FIG. 1.

Referring now to the drawings, there is illustrated the hand held defensive weapon 10 according to the invention. The device comprises a shaft 12 having a circular cross section and rounded ends 18 and 20. A finger ring 22 is secured to the shaft 20 by a pivot pin 23 received in a bore 24 in the shaft and retained in the bore 24 by an enlarged head 26. The bore 24 is positioned so that the end 16 of shaft 12 is approximately 54% of the total length of the shaft 12, leaving 46% of the length of the shaft 12 for the end 14. Such a longitudinal position for the bore 24 results in a pivoting relationship with sufficient inbalance that the end 16 is influenced by gravity to cause the shaft 12 to assume a vertical orientation.

Alternatively, the defender may utilize the inbalance to rotate the shaft 12 as will be described more fully hereinafter. The shaft 12 has a diameter of approximately 0.375 inches and is approximately 5½ inches in length. The shaft diameter is important in obtaining maximum results with the use of the invention. Shaft diameters smaller than 0.375 inches are difficult to grasp and have a tendency to inflict potentially fatal puncture wounds on the attacker. Larger shaft diameters dissipate too much of the power of the hand in holding the shaft thereby leaving less strength for defensive blows delivered by the weapon.

The device may be made by any material having sufficient strength to withstand impact blows delivered by an attacker. However, the use of steel is preferred. Steel has sufficient strength for both the protective and defensive blow roles for the device and has a density that results in adequate inertia. For example, when used for striking defensive blows, the inertia of the weapon corresponds to the follow through of the blow, thereby the weapon does not exert excessive force on the defender's hand or fingers. Similar considerations apply in the protective role; the inertia of the steel prevents a blow, parried by the defender, from transferring excessive force to the defender's hand or fingers.

Figure 3:
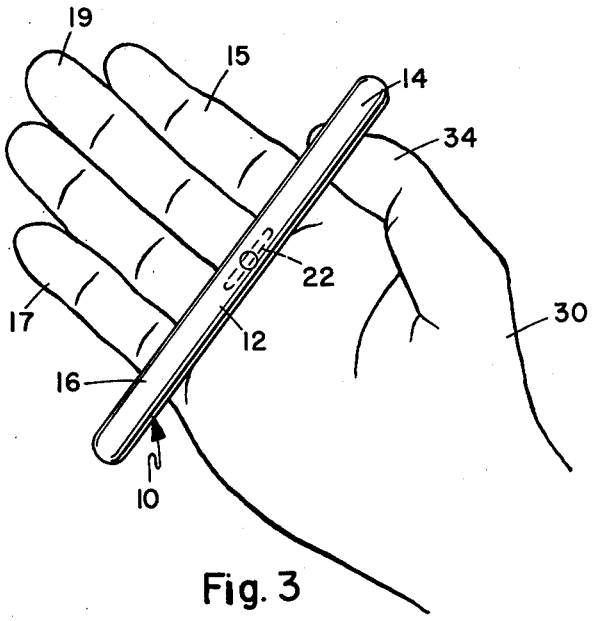
FIG. 3 through 5 illustrate various techniques for holding the weapon.

Referring specifically to FIG. 3, the shaft 12 is illustrated in the cross-palm position on a defender's open hand 30. It will be noted that the end 14 extends beyond the index finger 15 and thumb 34 and the end 16 extends beyond the little finger 17. The ring 22 is received over and near the base of the middle finger 19. The weapon 10 is utilized in the position illustrated for parrying knife thrusts and the like directed at the defender's mid-section. In this use, the hand and arm are held essentially horizontal and the arm swung across the front of the defender's body to contact the attacker's knife, or other weapon and deflect it away from the defender's body.

Figure 4:
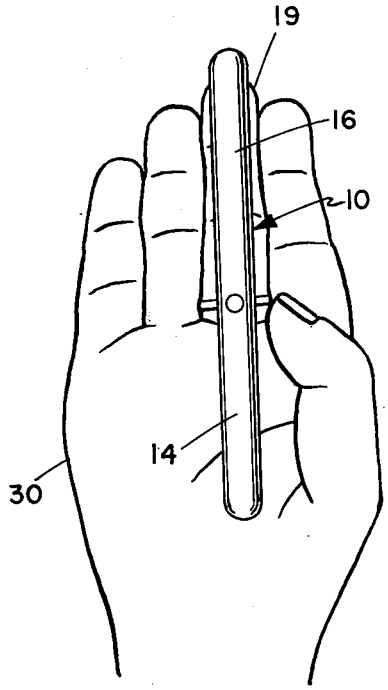

Blows directed at the defender from above, such as by swinging of a stick down toward the defender's head are parried with the weapon 10 in the position as illustrated in FIG. 4. The shaft 12 in this position is in approximate alignment with the extended fingers. The defender may manipulate the shaft 12 from the FIG. 3 position to the FIG. 4 position by a quick movement of the hand which causes the heavy end 16 of the shaft 12 to move from the cross-palm position to the orthogonally related finger aligned position. When the shaft 12 assumes the correct orientation, the defender presses against the shaft with the fingers so that the shaft bears against the fingers and the palm of the defender's hand 30 and is thereby frictionally held in position.

Figure 5:
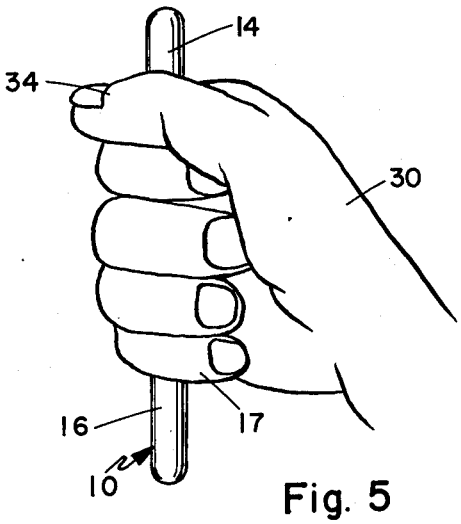

Referring now to FIG. 5, the use of the weapon in the defender's closed fist is illustrated. The fingers are wrapped around the device in the cross-palm position, so that the shaft 12 is grasped between the fingers and thumb. It will be noted that the end 14 extends beyond the thumb 34 and the end 16 extends beyond the little finger 17, so that the weapon 10 may be utilized to strike blows with either side of the defender's hand 30 orientated toward the attacker's body. Thus, if the defender has just parried an attacking blow utilizing the finger aligned position of FIG. 4, he may then draw his hand downwardly to cause the shaft 12 to assume the cross-palm position and then grasp the shaft in his fist. The defender may then thrust, jab or swing his fist as appropriate. As will be apparent, particularly to students of the martial arts, the defender is in the advantageous position of being able to readily deliver a disabling blow to the attacker with either end of the shaft 12 or by striking the attacker with the finger ring 22. The ability to strike the attacker with any of these three orientations of the closed fist increase the ability to strike a blow in a disabling area of the attacker's body.

Having described our invention, we now claim:

1. A hand held defensive weapon of the type that may be grasped in a defender's fist for use in fending off an attacker and for use by the defender in striking disabling defensive blows comprising:

an elongated metal shaft for being grasped within the defender's substantially completely closed fist, said shaft having blunt striking ends and said shaft extending beyond the closed fist on at least one side thereof, a finger ring comprising a ring for being received over one of the defender's fingers near the base thereof, pivot means for mounting said ring on said shaft for pivotal movement between a first position wherein said shaft may be aligned with the defender's fingers and a second position orthogonally related to said first position wherein said shaft may be grasped by a defender's fist.

2. The hand held defensive weapon according to claim 1 wherein:

said elongated metal shaft has a substantially circular cross section.

3. The hand held defensive weapon of claim 2 wherein:

said shaft incorporates rounded ends.

4. The hand held defensive weapon of claim 2 wherein:

said shaft is approximately 5½ inches in length.

5. The hand held defensive weapon of claim 1 wherein:

said pivot means is offset from the longitudinal center of said shaft.

6. The hand held defensive weapon of claim 5 wherein:

said pivot means is positioned substantially at 54% of the longitudinal extent of said shaft.

7. The hand held defensive weapon of claim 1 wherein:

said shaft is approximately 0.375 inches in diameter.

8. The hand held defensive weapon of claim 1 wherein:

said shaft is comprised of steel.

9. The hand held defensive weapon of claim 1 wherein:

said elongated metal shaft has a substantially circular cross section, said shaft being approximately 5½ inches in length and approximately 0.375 inches in diameter, said pivot means comprises a pivot pin extending through and retained within said shaft, said pivot means is offset from the longitudinal center of said shaft substantially at 54% of the longitudinal extent of said shaft.

10. A hand held defensive weapon of the type that may be grasped in a defender's fist for use in fending off an attacker and for use by the defender in striking disabling defensive blows comprising:

an elongated metal shaft for being grasped within a defender's substantially completely closed fist, said shaft extending beyond the closed fist on at least one side thereof, a finger ring comprising a substantially rigid, substantially circular metal ring for being received over one of the defender's fingers near the base thereof, pivot means for mounting said ring at a fixed position along said shaft for pivotal movement between a first position wherein said shaft may be aligned with the defender's fingers and a second position orthogonally related to the first position wherein said shaft may be grasped in a defender's fist, said pivot means being positioned substantially at 54% of the longitudinal extent of said shaft.

11. A hand held defensive weapon of the type that may be grasped in a defender's fist for use in fending off an attacker and for use by the defender in striking disabling defensive blows comprising:

an elongated metal shaft for being grasped within a defender's substantially completely closed fist, said shaft extending beyond the closed fist on at least one side thereof, a finger ring comprising a substantially circular metal ring for being received over one of the defender's fingers near the base thereof, pivot means for mounting said ring on said shaft for pivotal movement between a first position wherein said shaft may be aligned with the defender's fingers and a second position orthogonally related to said first position wherein said shaft may be grasped in a defender's fist, said pivot means comprising a pivot pin extending through and retained on said shaft.

12. The hand held defensive weapon of claim 11 wherein:

said elongated metal shaft has a substantially circular cross section, said shaft being approximately 5½ inches in length and approximately 0.375 inches in diameter, said pivot means is offset from the longitudinal center of said shaft substantially at 54% of the longitudinal extent of said shaft.

* * * * *